US005746098A

United States Patent [19]

Harrison

[11] Patent Number: 5,746,098

[45] Date of Patent: May 5, 1998

[54] ADJUSTABLE SPANNERS

[76] Inventor: Ian Austin Harrison, 1,2 & 3 Cambridge Rd., Eastbourne, East Sussex, BN22 7BP, Great Britain

[21] Appl. No.: 714,032

[22] Filed: Sep. 11, 1996

Related U.S. Application Data

[63] Continuation of Ser. No. 430,117, Apr. 27, 1995, abandoned, which is a continuation of Ser. No. 137,025, filed as PCT/GB92/00649, Apr. 10, 1992, published as WO92/18288, Oct. 29, 1992, abandoned.

[30] Foreign Application Priority Data

Apr. 15, 1991 [GB] United Kingdom ..... 9107930
Jun. 19, 1991 [GB] United Kingdom ..... 9113264

[51] Int. Cl.[6] ..... B25B 13/22

[52] U.S. Cl. ..... 81/143; 81/142

[58] Field of Search ..... 81/142, 143

[56] References Cited

U.S. PATENT DOCUMENTS 951,849 3/1910 Sipos ..... 81/143
2,015,895 10/1935 Hagbo ..... 81/143
3,535,959 10/1970 Riza .
4,106,372 8/1978 Miller .

FOREIGN PATENT DOCUMENTS 88 238 2/1921 Switzerland .
2 240 502 8/1991 United Kingdom .

*Primary Examiner*—James G. Smith
*Attorney, Agent, or Firm*—Lowe, Price, LeBlanc & Becker

[57] ABSTRACT

The invention provides an adjustable spanner having one fixed jaw (11) and one movable jaw (12), the fixed jaw being mounted on or formed integrally with the body or handle (10) of the spanner, and the movable jaw being arranged to slide in the body or handle of the spanner relative to the fixed jaw, in which the movable jaw (12) is provided with a first set of serrations (15) and a locking member (17) provided with a second set of secretions (16) is movably mounted in the body of the spanner to move between a locking position in which said second set of serrations engage with said first set of serrations to lock the movable jaw (12) in an operative position, and a release position in which the second set of serrations are clear of said first set of serrations to allow adjusting movement of the movable jaw; wherein releasable locking means (21) is provided for locking the locking member (17) positively in said locking position.

7 Claims, 2 Drawing Sheets

10
26
25
22
28
20
19
11
12
24
23
25
21
15
26
13
11
12
30
29
16
18
17
27
22
10

10
26
25 22
14
11

ADJUSTABLE SPANNERS

This application is a continuation of application Ser. No. 08/430,117 filed Apr. 27, 1995 abandoned, which is a continuation of application Ser. No. 08/137,025, filed as PCT/GB92/00649, Apr. 10, 1992 published as WO92/18288, Oct. 29, 1992 abandoned.

FIELD OF THE INVENTION

This invention relates to an adjustable spanner.

Adjustable spanners were well known to have one jaw of the spanner fixed to a handle, and a second jaw of the spanner adjustable relative to the first by means of a screw threaded device embodied in the handle.

The adjustment of such spanners is a time consuming operation, and the inevitable amount of slack or backlash between the screw mechanism and the movable spanner jaw, means that they rarely make a positive engagement on the faces of a hexagonal nut in the fashion of a fixed spanner.

SUMMARY OF THE DISCLOSURE

It is an object of the present invention to provide an adjustable spanner which alleviates these disadvantages.

An adjustable spanner having one fixed jaw and one movable jaw, the fixed jaw being mounted on or formed integrally with the body or handle of the spanner, and the movable jaw being arranged to slide in the body or handle of the spanner relative to the fixed jaw; in which the movable jaw is provided with a first set of serrations and a locking member provided with a second set of serrations is movably mounted in the body of the spanner to move between a locking position in which said second set of serrations engage with said first set of serrations to lock the movable jaw in an operation position, and a release position in which the second set of serrations are clear of said first set of serrations to allow adjusting movement of the movable jaw; wherein releasable locking means is provided for locking the locking member positively in said locking position, and wherein said locking means comprises a pin which is slideably mounted in said body or handle for axial movement between a locking and a release position, said pin having a cam surface adapted to engage said locking member and urge it towards the movable jaw on movement of the pin between its locking and release positions.

The pin may be of circular cross-section, in which case the cam surface is a tapered portion on the surface of the pin.

The pin may be of rectangular cross-section, in which case the cam surface is an inclined portion on one side thereof.

Preferably the locking member is resiliently biased away from the movable jaw by means of a spring.

Preferably the first and second sets of serrations have a pitch distance corresponding to the increments in the size of the nuts to be turned by the spanner.

Preferably a scale arrangement is provided between the fixed and movable jaws so that the setting of the spanner may be indicated.

In order to promote a fuller understanding of the above and other aspects of the present invention, an embodiment will now be described, by way of example only, with reference to the accompanying drawings, in which:

DETAILED DESCRIPTION OF THE PREFERRED EMBODIMENTS

Figures 1, 2, 3:
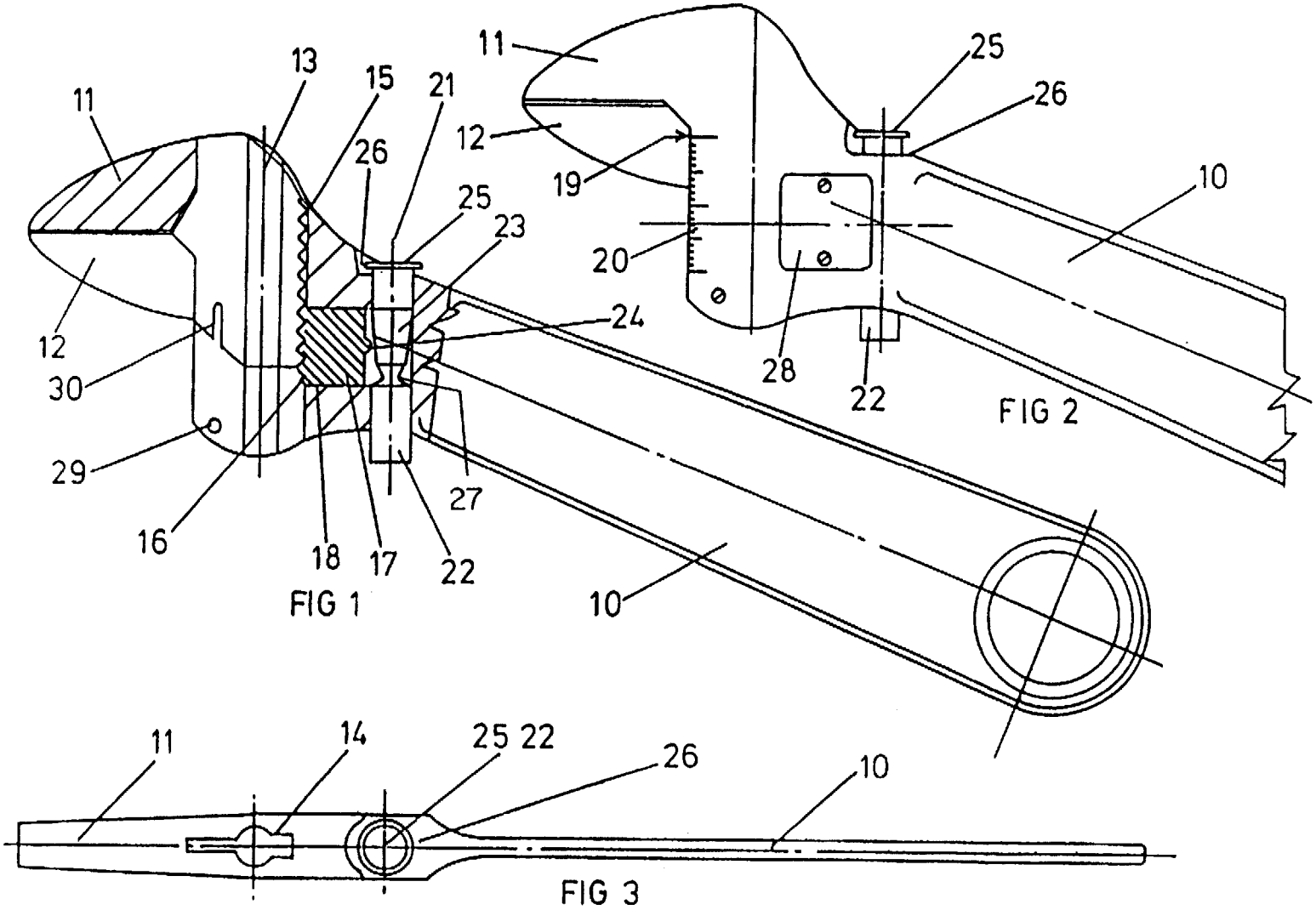
FIG. 1 shows a side view in part cross-section of a spanner embodying the invention.
FIG. 2 shows an external view of the spanner of FIG. 1.
FIG. 3 shows a top view of the spanner of FIG. 1.

The spanner shown in FIGS. 1, 2 and 3 of the accompanying drawings, comprises a handle 10 having a fixed spanner jaw 11 formed integrally therewith, and a movable spanner jaw 12 which is freely slidable in the body of the spanner which is formed integrally with the handle 10. The movable jaw 12 has a "keyhole" shaped projection 13 which moves in a correspondingly shaped slot 14 formed in the body of the spanner adjacent to fixed jaw 11, in conventional manner per set.

A rear surface of the movable jaw 12 is provided with a first set of serrations 15 which can be engaged by a corresponding second set of serrations 16 which are formed on a locking member 17. The locking member 17 is slidably mounted in a suitably aperture 18, which is formed in the body of the spanner, so as to be movable in a direction transverse to the direction of movement of the movable jaw 12, between a locking position with the first set of serrations in engagement with the second set, and a release position with the first set of serrations clear of the second set. It can be seen that with the locking member in such locking position, the movable jaw 12 is securely locked in a position to fit a chose nut size, while with the locking member in such release position, the movable jaw may be freely adjusted to a chosen nut size.

The serrations 15 and 16 which are naturally of matching pitch, are preferably chosen in pitch to correspond either to inch size or metric size increments of nut sizes upon which the spanner is to be used. The movable jaw 12 may also be provided with an engraved pointer 19 which moves against a scale 20 provided on the fixed jaw or body of the spanner (see FIG. 2), so that the movable jaw may be set to a given nut size for use.

Locking means indicated generally at 21 is provided in the body of the spanner to releasably engage and retain the locking member 17 in the locking position with its serrations 10 in engagement with the serrations 15 of the movable jaw 12 of the spanner. In this embodiment the locking means 21 comprises a pin 22 which is slidably mounted in the body of the spanner 10 for movement, in a direction transverse to that of the locking member 17, and generally parallel with that of the movable jaw 12. The pin 22 is provided with a cam surface in the form of a tapered portion 23 which is arranged to engage a projection 24 formed on the back of the locking member 17.

Thus it can be seen that downward movement, as seen in the drawings, of the pin 22, between a release position and a locking position, will cause the locking member 17 to move into its locking position in engagement with the movable jaw 12 and lock it in that locking position. The taper 23 can be made "self-locking" so that moderate force on the top of the pin 22 will achieve a firm locking of the movable jaw 12, which may be enhanced by a light tap in the top pin 22. A shoulder 25 is provided around the top of the pin 22 arranged to engage a shoulder 26 formed in the body of the spanner to prevent the pin 22 moving into the body of the spanner beyond the distance necessary for secure locking. A necked portion 27 is formed on the pin 22 immediately below the tapered portion 23 to provide a recess so that when the tapered pin is moved upwards, as seen in the drawings, the locking member 17 is released and the projection 24 may be received in the recess, allowing free movement of the movable jaw 12 with the serrations out of engagement.

The locking member 17 may be assembled in the body of the spanner through a suitable aperture in a side face which is subsequently covered by a cover plate 28, as shown in FIG. 2.

A stop screw 29 may be provided in the body of the spanner to engage in a corresponding slot 30 in the movable jaw 12, to prevent the movable jaw from falling completely out of the spanner when the locking member 17 is released. The engagement of the stop screw 29 in the slot 30, which occurs at wide or large settings of the spanner, also helps to transmit torque forces from the handle to the movable jaw, thus promoting the rigidity of the spanner in use at large settings.

Thus it can be seen that the embodiment provides an adjustable spanner which can be firmly locked in a chosen adjusted position to accommodate a given nut size, by the simple expedient of moving the pin 22 into a locking position, with a suitable tap from a hammer if necessary. Further, on release of the pin 22, with a suitable tap from a hammer if necessary on the bottom end, the adjustable jaw is released and can be easily adjusted to a chosen size. Once the movable jaw is locked by means of the pin 22 and locking member 17, the adjustable spanner behaves as if it was a solid spanner and thus alleviates the disadvantages of previous adjustable spanners as discussed above.

Figures 4, 5, 6:
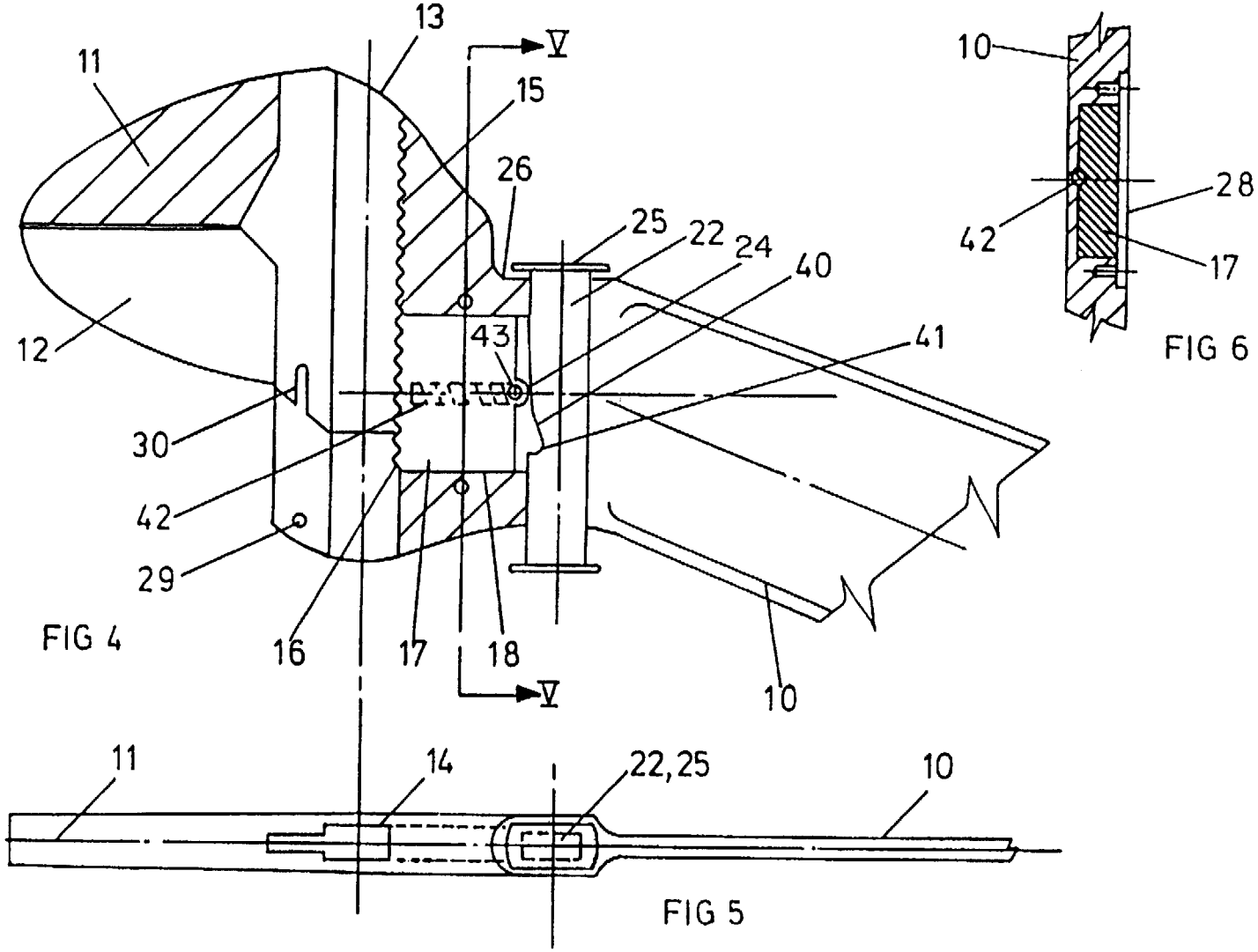
FIG. 4 shows a view similar to FIG. 1 of a further spanner embodying the invention.
FIG. 5 shows a top view of the spanner of FIG. 4.
FIG. 6 shows a part cross-section on the line VI—VI of FIG. 4.

FIGS. 4, 5 and 6 show a further spanner embodying the invention which is generally similar to that of FIGS. 1, 2 and 3; and where parts have a generally common design or purpose to those of FIGS. 1, 2 and 3, they have been given the same reference numbers.

In this arrangement, the pin 22 is of rectangular cross-section and slides in a corresponding cross-section slot in the body of the spanner. The tapered portion 23 of the previous embodiment is replaced by an inclined cam surface 40, while the recessed or necked part 27 of the previous embodiment is replaced by a recess 41.

In this embodiment a compression coil spring 42 is provided to be active between a shoulder formed in the body of the spanner and a pin 43 provided in the locking member 17 adjacent the projection 24, thus to bias the locking member 17 into its release position.

In other respects the embodiment of FIGS. 4, 5 and 6 operates in an exactly similar fashion to that of FIGS. 1, 2 and 3.

Thus it can be seen that the present invention in its various embodiments, provides and adjustable spanner which can be firmly locked in position to accommodate a given nut size, while providing for the simple and convenient adjustment of the spanner to suit various nut sizes.

In this disclosure, there are shown and described only the preferred embodiments of the invention, but, as aforementioned, it is to be understood that the invention is capable of use in various other combinations and environments and is capable of changes or modifications within the scope of the inventive concept as expressed herein.

I claim:

1. An adjustable spanner, comprising:

a) a body provided with a fixed jaw and a handle, and having a bore extending through said body;

b) a movable jaw mounted in said body for sliding movement relative to said fixed jaw, said movable jaw having a surface provided with a first set of serrations;

c) a locking member having a surface provided with a second set of serrations, and a projection provided on an opposite surface to the serrations with said projection extending transversely into said bore, said locking member being mounted in said body so as to be movable between a locking position in which said second set of serrations engages with said first set of serrations to lock said movable jaw in an operative position and a release position in which said second set of serrations is clear of said first set of serrations to allow adjusting movement of said movable jaw, said locking member comprising a spring and being resiliently biased away from said movable jaw by the spring;

d) a locking pin being mounted in the bore of said body for sliding axial movement between a release position and a locking position, said pin extending through said bore so as to project form both ends of said bore to be accessible to a user on both sides of said body, said pin having a recessed portion in its surface facing said projection, said recessed portion consisting of an inclined surface and, at the end of said inclined surface furthest spaced from said projection, a recess shaped to receive said projection, whereby axial movement of said locking pin by user pressure from one side of said body brings said inclined surface into engagement with said projection and further movement of said pin in the same direction causes said inclined surface to urge said locking member towards said movable jaw and bring said first and second sets of serrations into mutual engagement and then to wedge said locking member into its locking position, and axial movement of said locking pin the opposite direction by user pressure from the other side of said body releases the wedging action and further movement in said opposite direction changes the point of contact between said projection and said inclined surface so that said projection reaches said recess and moves into said recess under influence of said spring so as to bring said first and second sets of serrations out of engagement and allow free movement of said movable jaw.

2. The adjustable spanner as claimed in claim 1, wherein: said locking member is slidably mounted in said body to move in a direction transverse to a direction of movement of the movable jaw.

3. The adjustable spanner as claimed in claim 1, wherein: said pin is of circular cross-section and said inclined surface is a tapered portion of a surface of the pin.

4. The adjustable spanner as claimed in claim 1, wherein: said pin is of rectangular cross-section and said inclined surface is an inclined portion on one side thereof.

5. The adjustable spanner as claimed in claim 1, wherein: said pin is provided with a stop to prevent over-tightening of the locking means.

6. The adjustable spanner as claimed in claim 1, wherein: said first and second sets of serrations each have a pitch distance of the serrations corresponding to selected increments in a size of nuts to be engaged by the spanner.

7. The adjustable spanner as claimed in claim 1, further comprising:

a scale provided on one of said fixed and movable jaws and a pointer provided on the other one of said fixed and movable jaws, whereby a spanner setting is indicated.

* * * * *